US010183789B1

(12) United States Patent
Lin

(10) Patent No.: US 10,183,789 B1
(45) Date of Patent: Jan. 22, 2019

(54) LID LIFTING MECHANISM WITH SLIDING CLOSURE

(71) Applicant: Tsai-Hui Lin, Kaohsiung (TW)

(72) Inventor: Tsai-Hui Lin, Kaohsiung (TW)

( * ) Notice: Subject to any disclaimer, the term of this patent is extended or adjusted under 35 U.S.C. 154(b) by 21 days.

(21) Appl. No.: 15/657,540

(22) Filed: Jul. 24, 2017

(51) Int. Cl.

| | |
|---|---|
| ***B65D 51/24*** | (2006.01) |
| ***B65D 51/28*** | (2006.01) |
| ***B65D 51/22*** | (2006.01) |
| ***B65D 47/08*** | (2006.01) |
| ***B65D 55/02*** | (2006.01) |
| ***A47G 19/22*** | (2006.01) |
| *B65D 39/08* | (2006.01) |

(52) U.S. Cl.
CPC ..... *B65D 47/0857* (2013.01); *A47G 19/2272* (2013.01); *B65D 51/242* (2013.01); *B65D 51/2892* (2013.01); *B65D 55/02* (2013.01); *B65D 39/08* (2013.01)

(58) Field of Classification Search
CPC ..... B65D 51/242; B65D 51/223; B65D 51/2892; B65D 39/08; B65D 47/0857; B65D 55/02; B65D 25/2835; B65D 25/2858; A47G 19/2272
USPC ..... 220/278, 810–816, 831, 832, 713–715, 220/817, 819, 844
See application file for complete search history.

(56) References Cited

U.S. PATENT DOCUMENTS

| | | | | |
|---|---|---|---|---|
| 5,199,597 | A * | 4/1993 | Gladish | A47G 19/12 220/254.9 |
| 7,011,227 | B2 * | 3/2006 | Ward | A47G 19/2272 220/254.3 |
| 8,240,498 | B2 * | 8/2012 | Ramsey | B65D 17/4014 220/254.3 |
| 9,565,958 | B2 * | 2/2017 | Liu | A47G 19/2272 |
| 9,908,687 | B2 * | 3/2018 | Chiou | A47G 19/2272 |
| 10,065,774 | B1 * | 9/2018 | Daniels, Jr. | B65D 47/0857 |
| 2006/0043091 | A1 * | 3/2006 | Pinelli | A47G 19/2272 220/254.3 |
| 2011/0233227 | A1 * | 9/2011 | Paris | B65D 17/506 220/810 |
| 2018/0050848 | A1 * | 2/2018 | Choltco-Devlin | B65D 55/02 |

FOREIGN PATENT DOCUMENTS

| | | |
|---|---|---|
| TW | M452926 U1 | 5/2013 |
| TW | M455698 U1 | 6/2013 |
| TW | M506114 U | 8/2015 |

* cited by examiner

*Primary Examiner* — Andrew Perreault
(74) *Attorney, Agent, or Firm* — Rosenberg, Klein & Lee

(57) ABSTRACT

A lid lifting mechanism with sliding closure is disclosed, which comprises a lid body pivoted with a lifting cover and assembled with a sliding block. When the lid body is covered by the lifting cover, the lifting cover is positioned by pushing the sliding block forward; and when the sliding block is pushed backward, the lifting cover is opened for convenient to drink the beverage. Therefore, the components in the lid lifting mechanism with sliding closure is less, not only decreasing the cost, but also make the assembly of thereof quick. Furthermore, the lifting mechanism with sliding closure is disassembled and cleaned conveniently, and the dirty is not easy to accumulate in it, increasing the actually utility.

7 Claims, 8 Drawing Sheets

LID LIFTING MECHANISM WITH SLIDING CLOSURE

BACKGROUND OF THE INVENTION

Field of the Invention

The present invention relates to a lid lifting mechanism with sliding closure. More particularly, the components in the lid lifting mechanism with sliding closure is less, not only decreasing the cost, but also make the assembly of thereof quick; furthermore, it can be disassembled and cleaned conveniently, and the dirty is not easy to accumulate in it, increasing the actually utility.

Description of Related Art

It is common that people use all kinds of containers for filling various beverages. The general beverage container is covered by a lid to prevent the beverage inside from spilling. However, for user to conveniently drink the beverage inside the container, the lid is formed with a lifting cover, making user conveniently drink the beverage inside the container via opening the lifting cover.

About the foregoing lid with the lifting cover, please refer to the TW Patent application with the Issue No. M506114U "Container lid with top cover having function for preventing from accidentally opening" which disclosed that the top cover is opened or closed by pressing the switch with lock mode. Furthermore, the TW Patent application with the Issue No. M455698U1 "Seal cover of beverage container" and the TW Patent application with the Issue No. M452926U1 "Seal cover of beverage container" all disclose that the top cover is opened or closed by pressing the switch with lock mode.

In the foregoing patents, it achieves the desired effect that the user can open the top cover of the lid conveniently, however, in the actually use, it is discovered that the whole structure is more complicated, so the assembly is inconvenient and time consuming, resulting that it still have improvement space in the whole structure design.

SUMMARY OF THE INVENTION

Accordingly, the object of the present invention is to provide a lid lifting mechanism with sliding closure, in which the components is less, not only decreasing the cost, but also make the assembly of thereof quick; furthermore, it is can be disassembled and cleaned conveniently, and the dirty is not easy to accumulate in it, increasing the actually utility.

For the above object, a lid lifting mechanism with sliding closure comprises a lid body, a lifting cover, and a sliding block.

The lid body comprises an assembling block, a pivoting protrusion, an embedding protrusion, a join block, a limiting protrusion, an aperture, a lip, a positioning slot, and at least one air hole. The assembling block is at a top surface of the lid body and formed with the pivoting protrusion at two sides of thereof. The embedding protrusion is at the two sides of the assembling block and behind the pivoting protrusion. The join block is at a front end of the assembling block and formed with the limiting protrusion at two sides of thereof. The aperture is in a leading edge of the lid body. The lip is on the lid body and corresponded to an outer peripheral edge of a front end of the aperture. The positioning slot is in an inner side of the lip. The air hole is on the lid body.

The lifting cover comprises a pivoting recess, an embedding recess, a plug, a stopper, a positioning block, and a fixing slot. The pivoting recess is formed at an inner peripheral edge of two sides of the lifting cover for joining with the pivoting protrusion at the two sides of the assembling block of the lid body. The embedding recess is formed at the inner peripheral edge of the two sides of the lifting cover and at a front end of the pivoting recess. When the lifting cover is lifted, the embedding protrusion is embedded in the embedding recess for preventing the lifting lid from randomly moving. The plug and the stopper are at a bottom surface of the lifting cover and respectively corresponded to the aperture and the air hole of the lid body. The positioning block is at a front peripheral edge of the lifting cover and corresponded to the positioning slot in the lip of the lid body. The fixing slot is at an inner edge of a rear end of the lifting cover.

The sliding block comprises a join recess, a limiting indentation for release, a limiting indentation for closure, and a fixing part. The join recess is at a bottom surface of the sliding block for joining to the join block of the lid body. The limiting indentation for release and the limiting indentation for closure are in a sidewall of the join recess and corresponded to the limiting protrusion of the join block, making the limiting protrusion move between the both. The fixing part is at a front end of the sliding block and corresponded to the fixing slot of the lifting cover.

According to an embodiment of the present invention, the assembling block is formed with an indication part at a top surface thereof, and the sliding block is formed with a shelter at a rear edge of the top end thereof, when the sliding block is pushed backward, the indication part is covered by the shelter.

According to an embodiment of the present invention, the lip of the lid body is formed with a concave arc section at an inner periphery edge thereof to connect with the aperture.

According to an embodiment of the present invention, the lid body is formed with a hole at an outer edge thereof for inserting a strap, thereby being convenient to carry.

According to an embodiment of the present invention, the lid body is formed with a screwing section at a bottom end thereof for connecting to a container.

According to an embodiment of the present invention, the sliding block is formed with a through hole at the sidewall of the join recess and between the limiting indentation for release and the limiting indentation for closure, thereby making the sidewall of the join recess thin to have compression elasticity, further making the limiting protrusion move between the limiting indentation for release and the limiting indentation for closure.

According to an embodiment of the present invention, the lifting mechanism with sliding closure further comprises a slip-proof part on a top surface of the sliding block to be convenient for pushing the sliding block.

DETAILED DESCRIPTION OF THE PREFERRED EMBODIMENT

Figure 1:
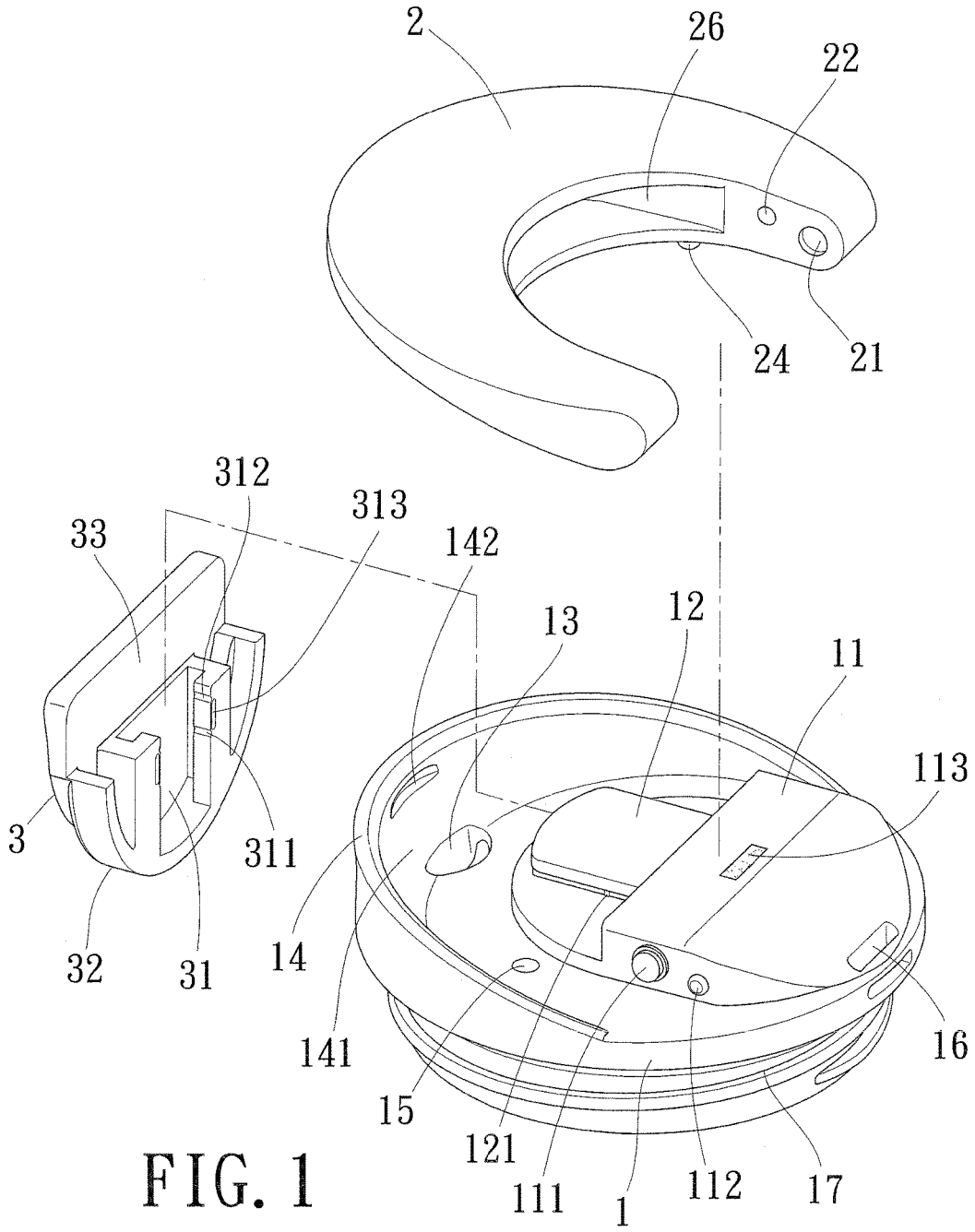
FIG. 1 is a three-dimensional exploded view of a lifting mechanism with sliding closure according to an embodiment of the present invention.
Figure 2:
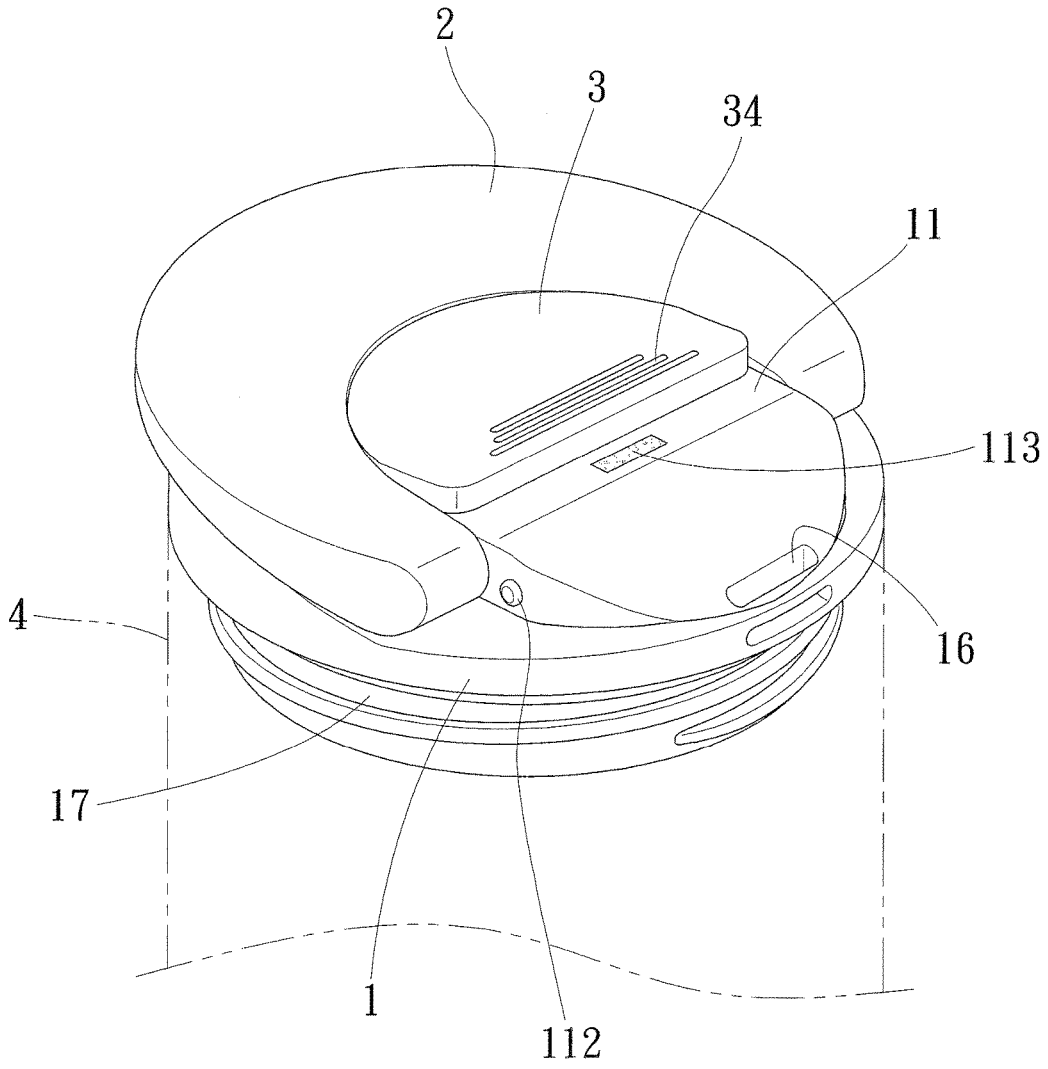
FIG. 2 is a three-dimensional perspective of the lifting mechanism with sliding closure according to an embodiment of the present invention.
Figure 3:
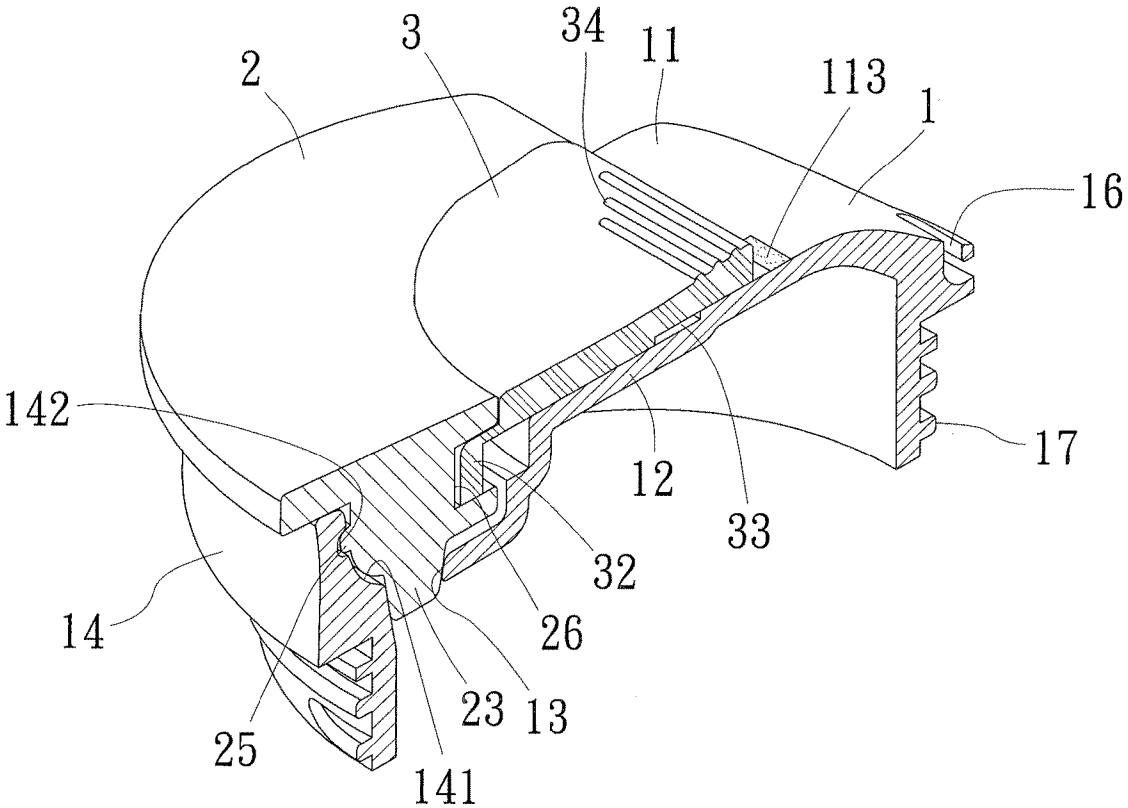
FIG. 3 is a three-dimensional sectional view of the lifting mechanism with sliding closure according to an embodiment of the present invention.
Figure 4:
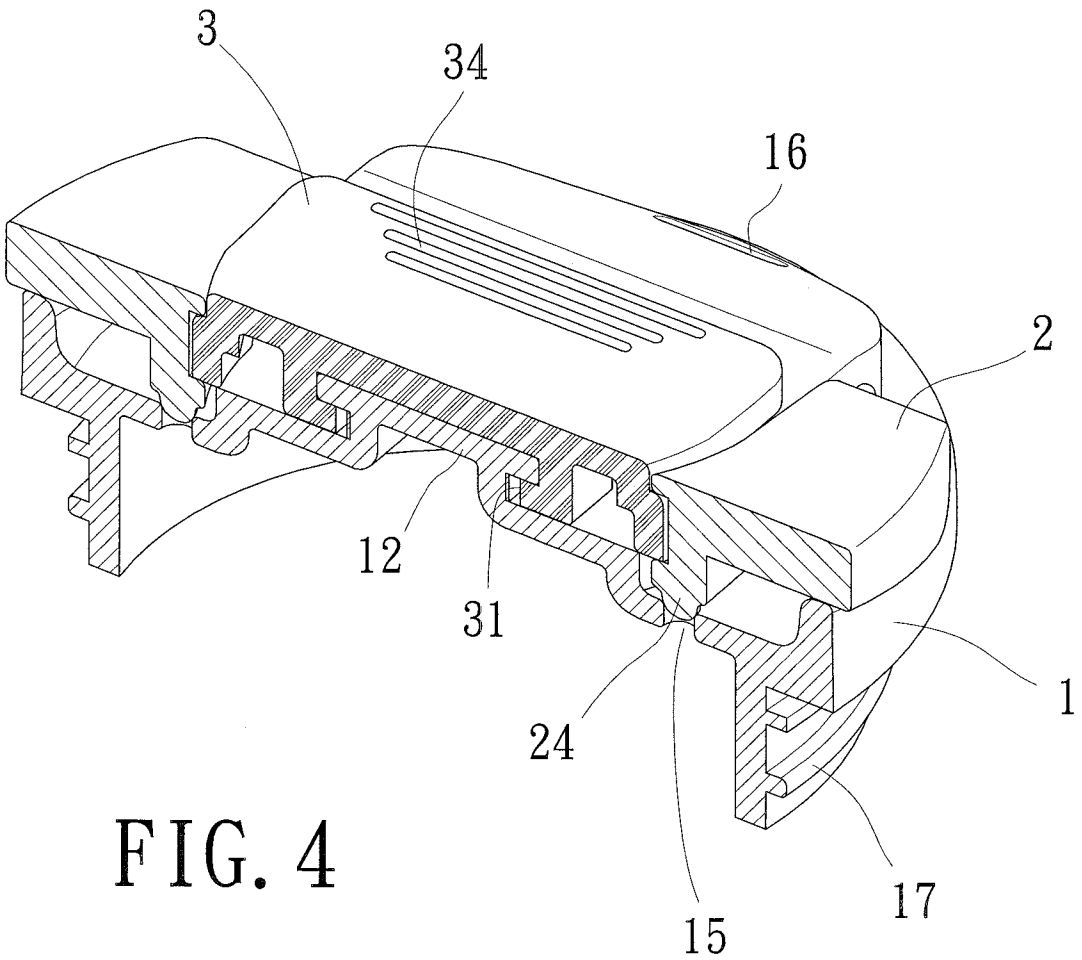
FIG. 4 is another three-dimensional sectional view of the lifting mechanism with sliding closure according to an embodiment of the present invention.
Figure 5:
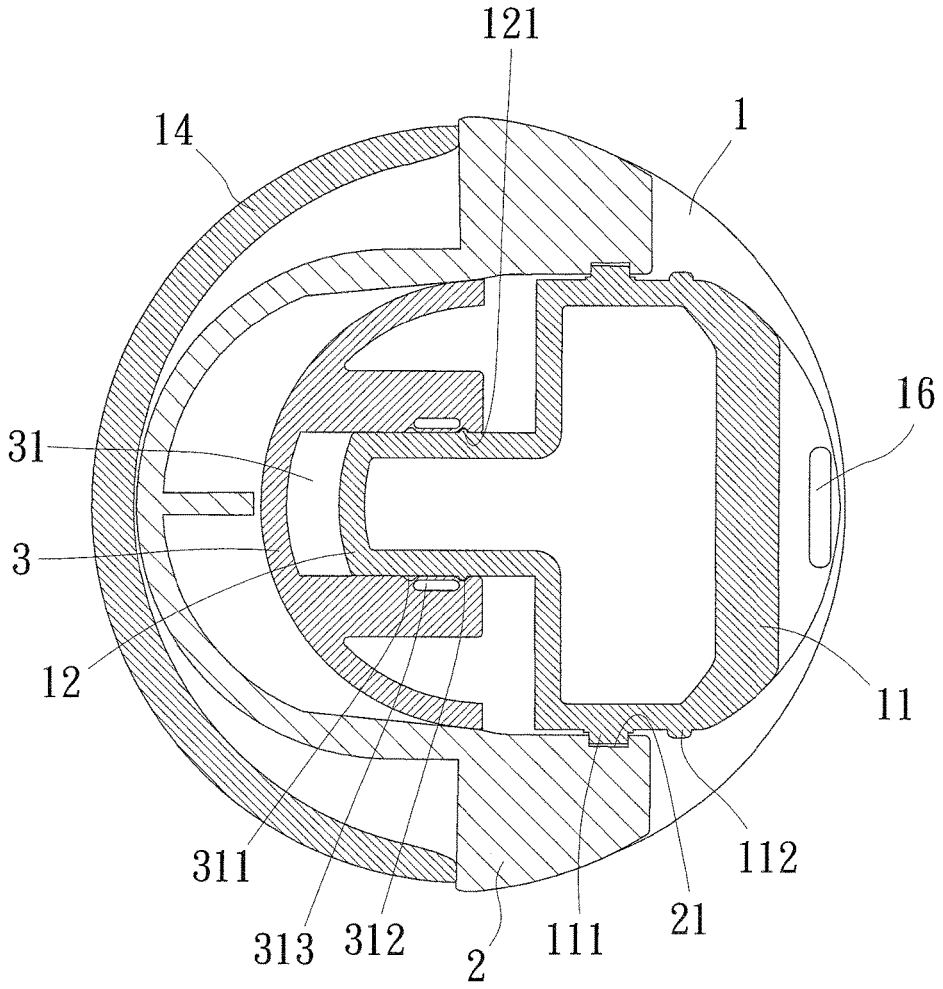
FIG. 5 is a sectional top view of the lifting mechanism with sliding closure according to an embodiment of the present invention.

Please refer to FIG. 1 to FIG. 5, which are a three-dimensional exploded view, a three-dimensional perspective, two three-dimensional sectional views from the different direction, and a sectional top view of a lifting mechanism with sliding closure according to an embodiment of the present invention. The lid lifting mechanism with sliding closure of the present invention comprises a lid body 1, a lifting cover 2, and a sliding block 3.

The lid body 1 comprises an assembling block 11, a join block 12, an aperture 13, a lip 14, at least one air hole 15, a hole 16 for inserting a strap, and a screwing section 17. The assembling block 11 is at a top surface of the lid body 1 and formed with a pivoting protrusion 111 and an embedding protrusion 112 at two sides of thereof, and the embedding protrusion 112 is behind the pivoting protrusion 111. Furthermore, the assembling block 11 is formed with an indication part 113 at a top surface thereof. The join block 12 is at a front end of the assembling block 11 and formed with a limiting protrusion 121 at two sides of thereof, which limiting protrusion 121 is corresponded to each other. The aperture 13 is in the leading edge of the lid body 1, and the lip 14 is at the lid body 1 and corresponded to an outer peripheral edge of a front end of the aperture 13. An inner periphery edge of the lip 14 is formed with a concave arc section 141 to connect with the aperture 13, and a positioning slot 142 is formed in an inner side of the lip 14. The air hole 15 is formed on the lid body 1. Moreover, the hole 16 for inserting a strap is formed at an outer edge of the lid body 1, thereby being convenient to carry, and the screwing section 17 is formed at a bottom end of the lid body 1 for connecting to a container 4.

The lifting cover 2 comprises a pivoting recess 21, an embedding recess 22, a plug 23, a stopper 24, a positioning block 25, and a fixing slot 26. The pivoting recess 21 is formed at an inner peripheral edge of two sides of the lifting cover 2 for joining with the pivoting protrusion 111 at the two sides of the assembling block 11 of the lid body 1, and the embedding recess 22 is formed at the inner peripheral edge of the two sides of the lifting cover 2 and at a front end of the pivoting recess 21. The plug 23 and the stopper 24 are formed at a bottom surface of the lifting cover 2 and respectively corresponded to the aperture 13 and the air hole 15 of the lid body 1. The positioning block 25 is formed at a front peripheral edge of the lifting cover 2 and corresponded to the positioning slot 142 in the lip 14 of the lid body 1. The fixing slot 26 is formed at an inner edge of a rear end of the lifting cover 2.

The sliding block 3 comprises a join recess 31, a fixing part 32, a shelter 33, and a slip-proof part 34. The join recess 31 is at a bottom surface of the sliding block 3 for joining to the join block 12 of the lid body 1. A limiting indentation for release 311 and a limiting indentation for closure 312 are formed at two sides of the join recess 31 to correspond to the limiting protrusion 121 of the join block 12, and a through hole 313 is formed at a sidewall of the join recess 31 and between the limiting indentation for release 311 and the limiting indentation for closure 312, thereby making the sidewall of the join recess 31 thin to have compression elasticity, further making the limiting protrusion 121 move between the limiting indentation for release 311 and the limiting indentation for closure 312. The fixing part 32 is formed at a front end of the sliding block 3 and corresponded to the fixing slot 26 of the lifting cover 2. The shelter 33 is formed at a rear edge of the top end of the sliding block 3 and corresponded to the indication part 113 of the assembling block 11 of the lid body 1, and the slip-proof part 34 is formed on a top surface of the sliding block 3 to be convenient for pushing the sliding block 3.

Thus the lid body 1 is covered by the lifting cover 2, making the plug 23 is inserted into the aperture 13 of the lid body 1; meanwhile, the stopper 24 is inserted into the air hole 15 of the lid body 1, preventing the liquid in the container from flowing out. Furthermore, the positioning block 25 of the lifting cover 2 is embedded in the positioning slot 142 of the lip 14 of the lid body 1. Then, the sliding block 3 is pushed forward to make the limiting protrusion 121 of the join block 12 move into the limiting indentation for closure 312 of the join recess 31, and the fixing part 32 of the sliding block 3 is engaged with the fixing slot 26 of the lifting cover 2, thereby fixing the lifting cover 2 and preventing the lifting cover 2 from opening. Moreover, the fixing part 32 is further pushed down to increase the closure effect, preventing the beverage in the container from spilling, so the container is at the closure status. When the container is at the closure status, the indication part 113 of the assembling block 11 is not covered by the shelter 33 of the sliding block 3.

Figure 6:
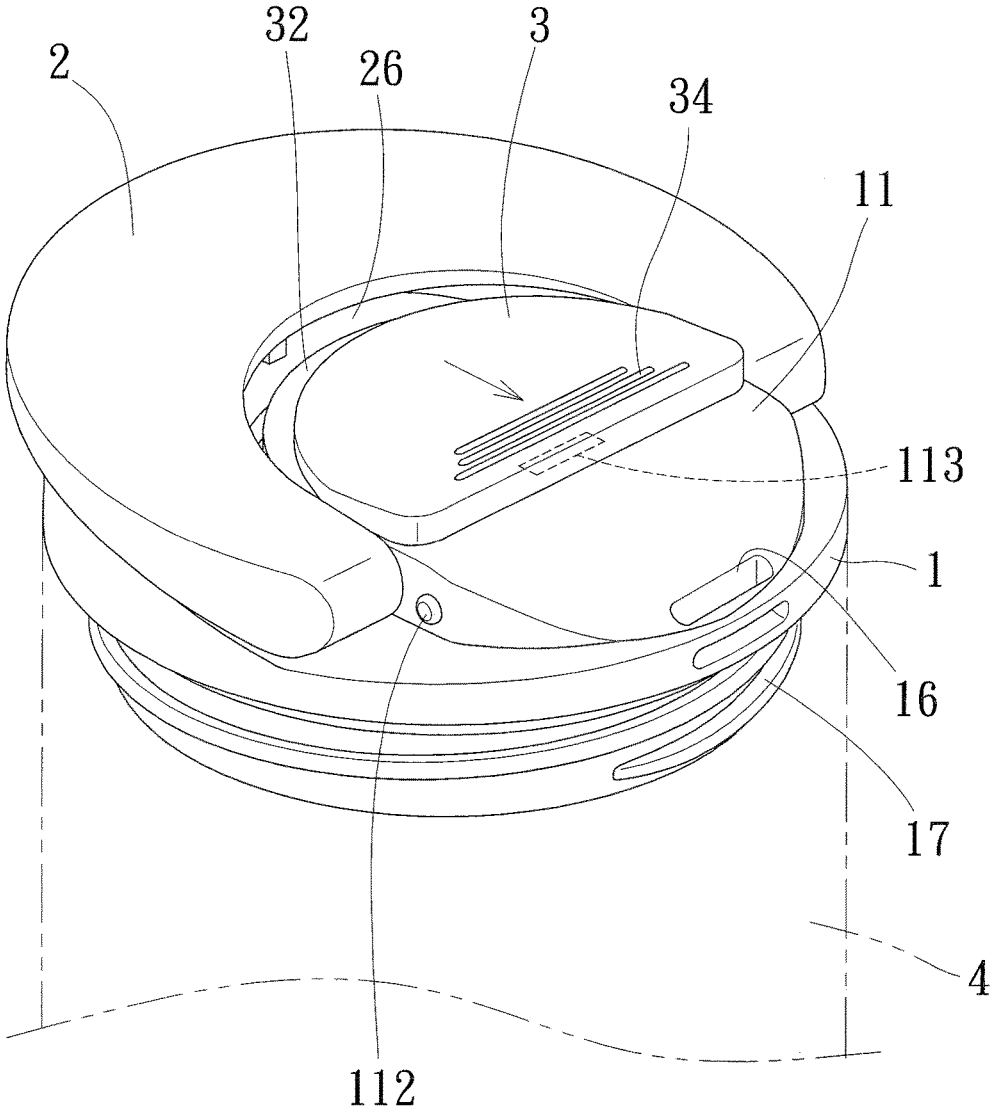
FIG. 6 is a three-dimensional perspective of the lifting mechanism with sliding closure when the sliding block is pushed backward according to an embodiment of the present invention.
Figure 7:
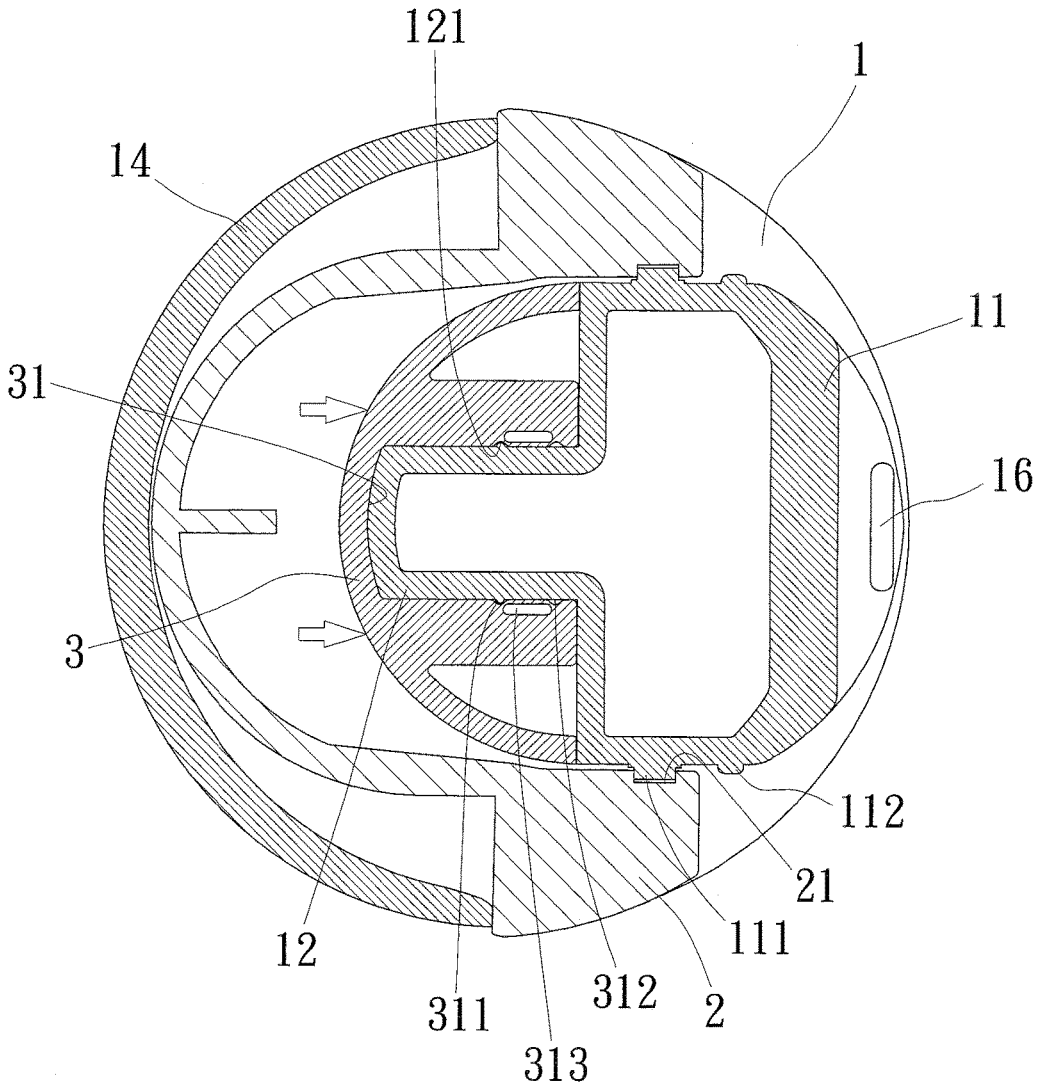
FIG. 7 is a sectional top view of the lifting mechanism with sliding closure when the sliding block is pushed backward according to an embodiment of the present invention.
Figure 8:
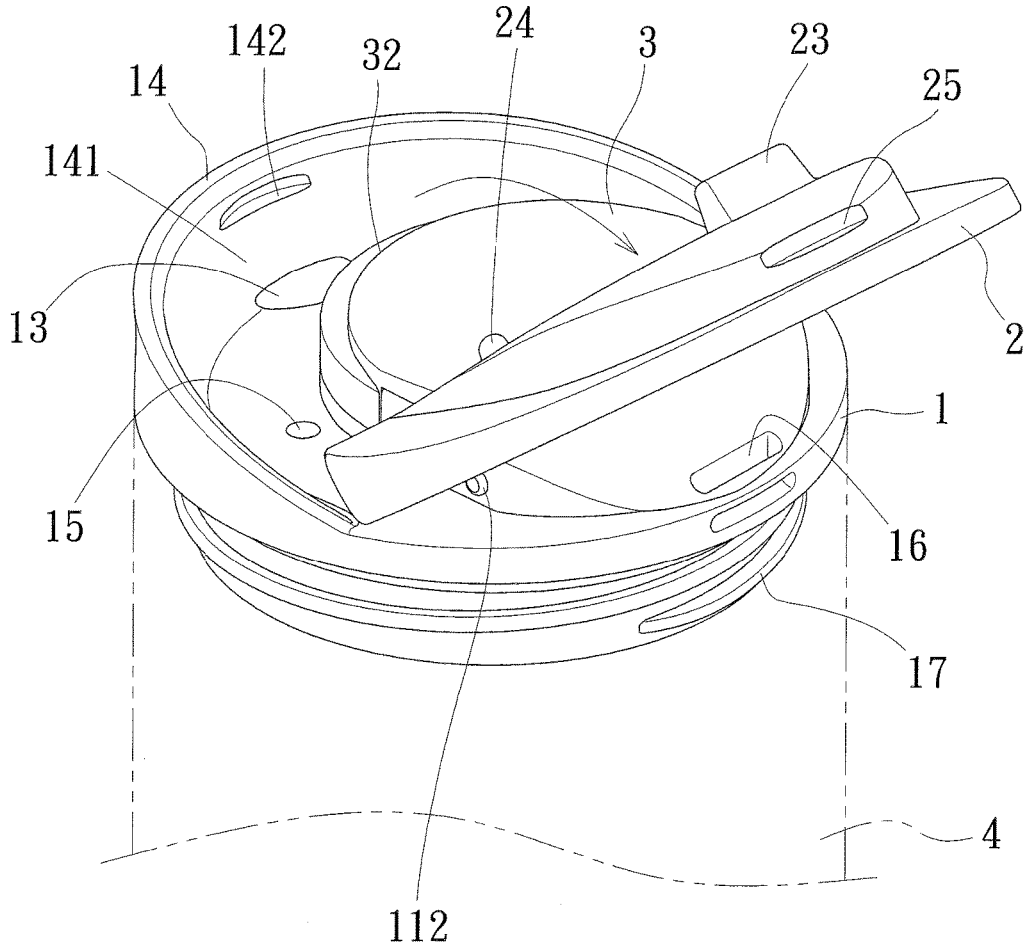
FIG. 8 is a three-dimensional perspective of the lifting mechanism with sliding closure when the lifting cover is opened according to an embodiment of the present invention.

Please refer to FIG. 6 and FIG. 7, which are a three-dimensional perspective and a sectional top view of the lifting mechanism with sliding closure when the sliding block is pushed backward according to an embodiment of the present invention. When the user wants to open the lifting cover 2, the sliding block 3 is pushed backward to make the limiting protrusion 121 of the join block 12 of the lid body 1 move into the limiting indentation for release 311 of the join recess 31 of the sliding block 3, and then the fixing part 32 of the sliding block 3 is disengaged from the fixing slot 26 of the lifting cover 2, meanwhile, the indication part 113 on the assembling block 11 of the lid body 1 is covered by the shelter 33 of the sliding block 3, thereby opening the lifting cover 2, please refer to FIG. 8, which is a three-dimensional perspective of the lifting mechanism with sliding closure when the lifting cover is opened according to an embodiment of the present invention. While the lifting cover 2 is opened, the plug 23 and the stopper 24 of the lifting cover 2 are respectively disengaged from the aperture 13 and the air hole 15 of the lid body 1. As the lifting cover 2 is totally opened backwardly, the embedding protrusion 112 of the assembling block 11 of the lid body 1 is embedded in the embedding recess 22 of the lifting cover 2, preventing the lifting cover 2 from randomly moving, it is convenient for the user to drink the beverage in the container 4 via the aperture 13.

According to the above description and embodiments, comparison with the existing structure of the lid, the lid lifting mechanism with sliding closure of the present invention has the advantage as following:

1. The lifting mechanism with sliding closure of the present invention comprises the lid body, the lifting cover, and the sliding block, so the components in the lid lifting mechanism with sliding closure of the present invention is less, not only decreasing the cost, but also make the assembly of thereof quick. Furthermore, it is disassembled and cleaned conveniently, and the dirty is not easy to accumulate in it.

2. In the lifting mechanism with sliding closure of the present invention, the concave arc section is formed at the inner periphery edge of the lip of the lid body to connect with the aperture, so the liquid is not accumulated between the lip and the aperture due to the design of the concave arc section.

3. In the lifting mechanism with sliding closure of the present invention, the lid body is formed with several air holes, so the beverage flows out smoothly when the user drinks it via the aperture.

4. In the lifting mechanism with sliding closure of the present invention, the sidewall of the join recess is formed with a through hole between the limiting indentation for release and the limiting indentation for closure, thereby making the sidewall of the join recess thin to have compression elasticity, so it is convenient for the limiting protrusion moving between the limiting indentation for release and the limiting indentation for closure, decreasing the wear of the limiting protrusion and extending the life time of the limiting protrusion.

5. When the lifting cover in the present invention is totally opened backward, the embedding protrusion of the assembling block of the lid body is embedded in the embedding recess of the lifting cover, preventing the lifting cover from randomly moving, so it is convenient for the user to drink the beverage.

6. In the lifting mechanism with sliding closure of the present invention, when the sliding block is pushed forward to make the fixing part of the sliding block engage with the fixing slot of the lifting cover, it is not only for fixing the lifting cover to prevent the lifting cover from opening; furthermore, the fixing part is further pushed down to increase the closure effect, preventing the beverage in the container from spilling.

7. The lid body of the present invention is formed with a hole at is the outer edge for inserting a strap, thereby being convenient to carry.

What is claimed is:

1. A lid lifting mechanism with sliding closure, comprising:

a lid body, comprising:

an assembling block, at a top surface of the lid body and formed with a pivoting protrusion at two sides of thereof;

an embedding protrusion, at the two sides of the assembling block and behind the pivoting protrusion;

a join block, at a front end of the assembling block and formed with a limiting protrusion at two sides thereof;

an aperture, in a leading edge of the lid body;

a lip, on the lid body and corresponded to an outer peripheral edge of a front end of the aperture;

a positioning slot, in an inner side of the lip; and at least one air hole, on the lid body;

a lifting cover, comprising:

a pivoting recess, formed at an inner peripheral edge of two sides of the lifting cover for joining with the pivoting protrusion at the two sides of the assembling block of the lid body;

an embedding recess, formed at the inner peripheral edge of the two sides of the lifting cover and at a front end of the pivoting recess, wherein when the lifting cover is lifted, the embedding protrusion of the lid body is embedded in the embedding recess for preventing the lifting cover from randomly moving;

a plug, at a bottom surface of the lifting cover and corresponded to the aperture of the lid body;

a stopper, at the bottom surface of the lifting cover and corresponded to the air hole of the lid body;

a positioning block, at a front peripheral edge of the lifting cover and corresponded to the positioning slot in the lip of the lid body; and a fixing slot, at an inner edge of a rear end of the lifting cover; and a sliding block, comprising:

a join recess, at a bottom surface of the sliding block for joining to the join block of the lid body;

a limiting indentation for release and a limiting indentation for closure, in a sidewall of the join recess and corresponded to the limiting protrusion of the join block, making the limiting protrusion move between the both; and a fixing part, at a front end of the sliding block and corresponded to the fixing slot of the lifting cover.

2. The lid lifting mechanism with sliding closure according to claim 1, wherein the assembling block is formed with an indication part at a top surface thereof, and the sliding block is formed with a shelter at the rear edge of a top end thereof, when the sliding block is pushed backward, the indication part is covered by the shelter.

3. The lid lifting mechanism with sliding closure according to claim 1, wherein the lip of the lid body is formed with a concave arc section at an inner periphery edge thereof to connect with the aperture.

4. The lid lifting mechanism with sliding closure according to claim 1, wherein the lid body is formed with a hole at an outer edge thereof for inserting a strap, thereby being convenient to carry.

5. The lid lifting mechanism with sliding closure according to claim 1, wherein the lid body is formed with a screwing section at the bottom end thereof for connecting to a container.

6. The lid lifting mechanism with sliding closure according to claim 1, wherein the sliding block is formed with a through hole at the sidewall of the join recess and between the limiting indentation for release and the limiting indentation for closure, thereby making the sidewall of the join recess thin to have compression elasticity, further making the limiting protrusion move between the limiting indentation for release and the limiting indentation for closure.

7. The lid lifting mechanism with sliding closure according to claim 1, further comprising a slip-proof part on a top surface of the sliding block to be convenient for pushing the sliding block.

* * * * *